United States Patent [19]

Hayashi

[11] 4,324,219

[45] Apr. 13, 1982

[54] SPARK INTENSIFIER IN GASOLINE ENGINE

[75] Inventor: Mikio Hayashi, Tokyo, Japan

[73] Assignee: Hayashi Seiko Kabushiki Kaisha, Tokyo, Japan

[21] Appl. No.: 168,528

[22] Filed: Jul. 14, 1980

Related U.S. Application Data

[63] Continuation of Ser. No. 12,828, Feb. 16, 1979, abandoned.

[51] Int. Cl.[3] ..... F02P 15/00

[52] U.S. Cl. ..... 123/620; 123/169 PA; 123/654

[58] Field of Search ..... 123/169 G, 169 PA, 169 PH, 123/620, 653, 654

[56] References Cited

U.S. PATENT DOCUMENTS

| | | | |
|---|---|---|---|
| 703,759 | 7/1902 | Brown | 123/169 PH |
| 1,514,496 | 11/1924 | Witter | 123/620 |
| 2,736,760 | 2/1956 | Kane, Jr. | 123/620 |

FOREIGN PATENT DOCUMENTS

| | | | |
|---|---|---|---|
| 1902199 | 8/1970 | Fed. Rep. of Germany | 123/169 G |

*Primary Examiner*—Tony M. Argenbright
*Attorney, Agent, or Firm*—C. O. Marshall, Jr.

[57] ABSTRACT

A high-tension secondary current generated from an ignition coil is accumulated in a capacitor set at the head of a spark plug in a gasoline engine for automobiles, etc., and when the voltage of the discharging shaft at the end of the spark plug has built up to a predetermined value for discharge, the static electricity accumulated in the capacitor is discharged at a stroke to let out strong sparks.

2 Claims, 6 Drawing Figures

SPARK INTENSIFIER IN GASOLINE ENGINE

This is a continuation of application Ser. No. 12,828 filed Feb. 16, 1979, now abandoned.

BACKGROUND OF THE INVENTION (1) Field of the Invention

This invention relates to a spark intensifying device adaptable in a gasoline engine for automobiles, etc., in which a high-tension secondary current generated from an ignition coil is accumulated in a capacitor set at the head of a spark plug in the engine, and when the voltage of the discharging shaft at the end of the spark plug has risen to a predetermined value for discharge, the static electricity accumulated in said capacitor is discharged at one effort to produce strong sparks.

(2) Description of the Prior Art

In many of the latest antipollution cars, the engine power and acceleration performance are sacrified for coming up to the strict regulations on emission of noxious matters such as HC, CO and NOx in exhaust gas. Recently, use of a transistorized ignition system is prevalent in the engines employing a so-called lean gas combustion system or other like systems for improving the engine performance at acceleration and preventing missparking. On the othe hand, the spark plug markers are making various attempts, such as changing the end configuration of the spark plug, for improving combustion efficiency.

An important and very difficult problem that arises in this connection is how to increase the high-voltage discharge current at the tip of the spark plug.

In the existing standard type automobiles which are not mounted with a full- or semi-transistorized system, the maximum voltage that is produced by the ignition coil is approximately 18 KV, and the discharge value attainable with the spark plug with discharging gap of about 0.8 mm by way of a plug cord is down to the order of 12 KV.

Although the secondary voltage generated by the ignition coil in the semi- or full-transistorized systems is amplified to the order of 40 KV, the discharge voltage at the tip of the spark plug with a discharging gap of about 1.1 drops to the level of 26 KV.

There is appearing on the market a plug cord which is so deviced as to lower resistance while minimizing current leakage in order to arrest voltage drop at the tip of the spark plug. Use of such plug cord, however, is not a decisive solution to the problems which are posed by the currently employed lean gas combustion system.

SUMMARY OF THE INVENTION

An object of this invention is to provide a spark intensifying device according to which the sparks given off from the spark plug are amplified several times the strength obtainable from the conventional plugs, so as to improve combustion efficiency and acceleration performance without sacrificing the engine power and to thereby realize sizable economization of fuel and reduction of emission of HC, CO, NOx and/or other noxious matters in engine exhaust.

Another object of this invention is to provide a spark intensifying device in which a high-voltage capacitor circuit is provided intermediate the spark plug and plug cord and in parallel to the discharging part of the discharge shaft at the end of the spark plug so that the high-voltage capacitor is discharged at the time of sparking and the discharged current is combined with the spark current of the spark plug to thereby obtain a powerful spark.

Still another object of this invention is to provide a spark intensifying device comprising a high-voltage capacitor which can be connected in parallel to the discharging part of the discharge shaft at the end of the spark plug by simply fixing said capacitor to the head of an existing spark plug.

In order to accomplish these objects, there is provided according to this invention a spark intensifying device comprising an insulating cylinder made of plastic, porcelain or other like material with excellent heat-resisting and insulating properties and high permittivty, a metallic outer cylinder sheathing said insulating cylinder and designed to serve as an electrode on the grounded side of the capacitor, a grounding member provided on said outer cylinder, a metallic inner cylinder disposed in the insulating cylinder in opposition to said metallic outer cylinder and designed to serve as an electrode on the positive side of the capacitor, and a terminal shaft passed centrally through said insulating cylinder while maintaining electrical connection with the bottom of said metallic inner cylinder, wherein said terminal shaft is disposed intermediate the discharge shaft of the existing spark plug and the plug cord to form an electric circuit so as to develop an electric field between said metallic outer and inner cylinders upon start of the engine, thereby to initiate sparking in the discharging gap of the discharge shaft of the spark plug, while the discharge current generated between said metallic outer and inner cylinders is combined with the spark current of the discharge shaft of the spark plug to strengthen the sparks whereby to ensure positive ignition of the fuel mist in the engine.

DESCRIPTION OF PREFERRED EMBODIMENTS

Figure 1:
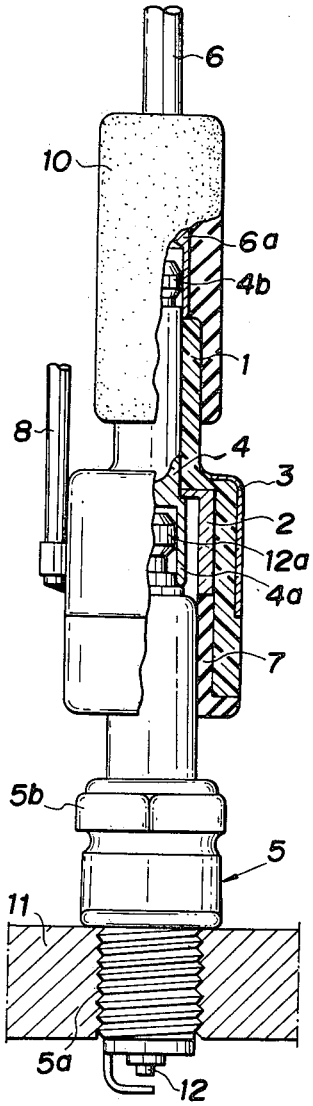
FIG. 1 is a longitudinal sectional view of a spark plug having adapted to its head an embodiment of this invention.
Figure 2:
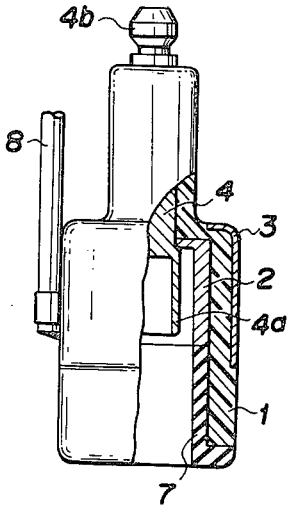
FIG. 2 is a partly cut-out side view of this embodiment of the invention.
Figure 3:
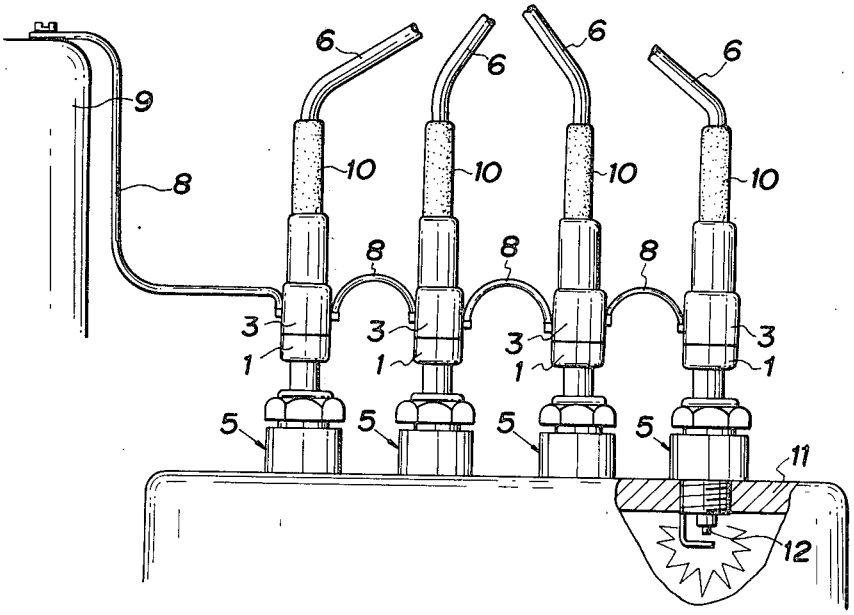
FIG. 3 is an external view of this embodiment of the invention as incorporated in a gasoline engine.

Referring to FIGS. 1 to 3, there is shown an embodiment of this invention as adapted to the head of a spark plug, comprising an insulating cylinder 1 constituting a dielectric, said cylinder being made of a material such as porcelain having excellent heat-resisting and insulating properties and high permittivity, a metallic inner cylinder 2 secured to the internal surface of said insulating cylinder 1 and designed to serve as one electrode plate of the capacitor, a metallic outer cylinder 3 sheathing the insulating cylinder 1 and designed to serve as the other electrode plate of the capacitor, and a terminal shaft 4 fitted in the insulating cylinder 1 in connection to the inner cylinder 2. 5 is a spark plug having a discharging shaft 12 projecting from the lower end thereof, with the upper end portion 12*a* of said discharging shaft being fitted into a recession 4*a* at the lower end of the terminal shaft 4. 6 is a plug cord which is connected at its end to a cord cap 10 and an electroconductive connecting pipe 6*a* fitted into said cord cap 10. The head 4*b* of the terminal shaft 4 is inserted into said connecting pipe 6*a*. Fitted in the lower end of the insulating cylinder 1 is a rubber-made insulating end cylinder 7 adapted to maintain engagement between said insulating cylinder 1 and spark plug 5. A grounding lead wire 8 is connected at its one end to the outer cylinder 3, the other end of said lead wire being connected to another outer cylinder (electrode) 3 or to the vehicle body 9 and thereby grounded. 11 refers to a gasoline engine cylinder head engaged with the external threaded end 5*a* of the spark plug 5. Designated also by numeral 10 is a cord cap adapted to assist joint of the plug cord 6 to the terminal shaft 4. 12 shows a discharging shaft constituting the positive pole of the spark plug. Said plug cord 6, terminal shaft 4, inner cylinder 2 and discharging shaft 12 are electrically connected to each other.

Figure 4:
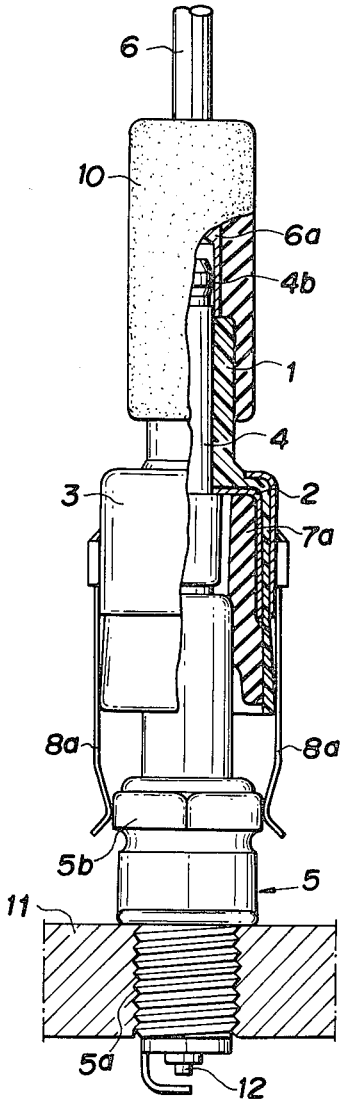
FIG. 4 is a longitudinal sectional view of a spark plug having adapted to its head another embodiment of this invention.
Figure 5:
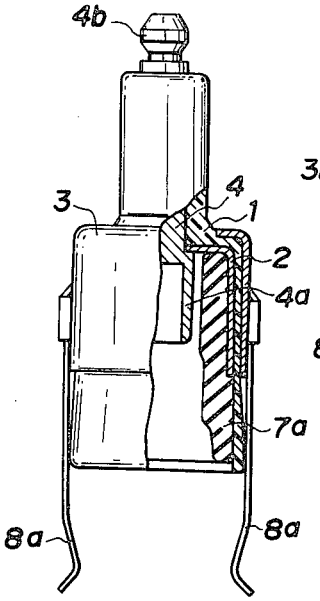
FIG. 5 is an exploded perspective view of this embodiment of the invention.
Figure 6:
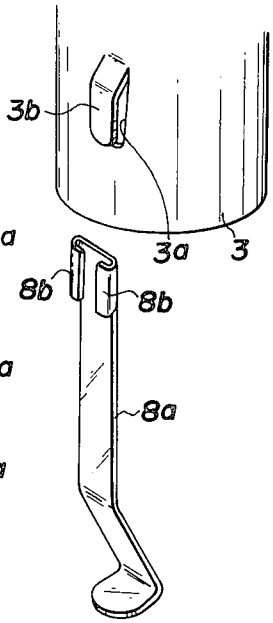
FIG. 6 is an enlarged perspective view of the contact plate portion in this embodiment of the invention.

Referring now to FIGS. 4 to 6, there is shown another embodiment of this invention in which the grounding lead is substituted by a contact plate 8*a* of which the upper end is bent at its both edges to form a pair of U-shaped engaging elements 8*b* while the lower end portion of said contact plate 8*a* is bent in S shape. The engaging elements 8*b* are fitted onto the corresponding protuberances 3*b* formed by stamping, in U shape 3*a*, both side faces of the outer cylinder 3 which acts as another electrode plate of the capacitor, and the top end 12*a* of the discharging shaft 12 of the spark plug 5 is fitted into the recession 4*a* in the lower end of the terminal shaft 4 so that the hexagonal head 5*b* of the spark plug is held by the lower ends of a pair of contact plates 8*a*, 8*a* to thereby ground the outer cylinder 3.

In this embodiment, the upper portion of the rubber-made insulating end cylinder 7*a* is so arranged as to sheathe the metallic inner cylinder 2.

When the gasoline engine is started, the ignition current generated from the distributor (not shown) flows through the plug cord 6 to the terminal shaft 4, and a portion of this current is charged on the end face of the discharging shaft 12 in the spark plug 5 while the other portion of said current is charged on the external surface of the inner cylinder 2. When the ignition current which is generated successively has been charged on said both charging faces to their capacities, the current is now discharged in the form of sparks from the discharging shaft 12. These sparks serve as a conductor for flowing the succeeding current, and this causes discharge of the static electricity which has been charged on the inner cylinder 2. Thus, the instantaneous spark current is increased by an amount equal to the current that has been charged on the inner cylinder 2. Accordingly, the sparks are strengthened to further encourage spark ignition.

Since every outer cylinder 3 is earthed to the vehicle body by a lead 8, a charging zone is formed between the outer cylinder 3 and inner cylinder 2 to allow accumulation of the spark current. However, when sparking begins from the discharging shaft 12, the static electricity in the inner cylinder 2 is all discharged out at one time through the sparks which serve as a current conductor. Therefore, as compared with the conventional devices, the instantaneous current of sparks is increased by an amount corresponding to the current accumulation in the inner and outer cylinders 2 and 3, resulting in the so much intensified sparks and enhanced ignitability of the fuel mixture.

According to the present invention, the spark plug and the capacitor members may be designed as separate units, and connection or separation of the discharging shaft of the spark plug and the terminal shaft in the inner cylinder forming a capacitor member can be effected by a single and simple operation by employing a plug-in system. Therefore, the device of this invention is easy to mount to or demount from any type of spark plugs used for various types of engines, including those mounted on the existing automobiles or on the new models, with no necessity of an adaptor.

What is claimed is:

1. A spark intensifier for gasoline engines comprising an insulating cylinder made of a material with excellent heat-resisting and insulating properties and high permittivity, a metallic outer cylinder sheathing said insulating cylinder, a grounding member connected to said outer cylinder, a metallic inner cylinder disposed in said insulating cylinder, and a terminal shaft secured at its central portion to said insulating cylinder and electrically connected to said inner cylinder, said terminal shaft being also electrically connected at its foremost end to a plug cord and at its lower end to a spark plug having a discharge shaft, the said three cylinders comprising a capacitor intermediate the spark plug and the plug cord and in parallel with the discharge shaft of the spark plug, whereby the discharge current of the capacitor is combined with the spark current of the spark plug at the time of sparking, and wherein an insulating end cylinder is surrounded by the lower portion of said insulating cylinder for insertion over the end of the spark plug, the upper end of the insulating end cylinder contacting the metallic inner cylinder and the lower end of the insulating end cylinder contacting said insulating cylinder.

2. A spark intensifier according to claim 1 wherein the grounding member is constituted from a pair of contact plates disposed in opposed relation to each other, said contact plates being secured at the top ends to the outer cylinder and so arranged that the lower ends thereof hold therebetween the head of the spark plug, and wherein protuberances are provided on the outer cylinder, each of said protuberances being inserted into and held securely by a corresponding holding member formed by inwardly bending both edges of the top end portion of each said contact plate, thereby to secure said outer cylinder and contact plates to each other.

* * * * *